US008567981B2

(12) United States Patent
Finnegan et al.

(10) Patent No.: US 8,567,981 B2
(45) Date of Patent: Oct. 29, 2013

(54) LASER AIMING DEVICE INTEGRATED INTO AN ELECTRO-OPTIC BATTERY SOURCE SUCH AS ASSOCIATED WITH A HOLOGRAPHIC SIGHT

(75) Inventors: Dennis Finnegan, Pickney, MI (US); Kevin Philbin, Pickney, MI (US)

(73) Assignee: Elite Research, LLC, Dexter, MI (US)

( * ) Notice: Subject to any disclaimer, the term of this patent is extended or adjusted under 35 U.S.C. 154(b) by 593 days.

(21) Appl. No.: 12/700,142

(22) Filed: Feb. 4, 2010

(65) Prior Publication Data

US 2011/0185619 A1 Aug. 4, 2011

(51) Int. Cl.
*F41G 1/34* (2006.01)

(52) U.S. Cl.
USPC ..... 362/110; 362/191; 362/259; 42/117; 42/146

(58) Field of Classification Search
USPC ..... 362/110–114, 190–191, 259; 42/114–117, 146
See application file for complete search history.

(56) References Cited

U.S. PATENT DOCUMENTS

| | | | | |
|---|---|---|---|---|
| 5,033,219 | A | 7/1991 | Johnson et al. | |
| 5,388,364 | A | 2/1995 | Paldino | |
| 5,485,695 | A | 1/1996 | Glock | |
| 5,555,662 | A * | 9/1996 | Teetzel | 42/115 |
| 5,685,106 | A | 11/1997 | Shoham | |
| 6,151,788 | A | 11/2000 | Cox et al. | |
| 6,216,381 | B1 | 4/2001 | Strand | |
| 6,363,648 | B1 | 4/2002 | Kranich et al. | |
| 6,389,730 | B1 | 5/2002 | Millard | |
| 6,606,797 | B1 | 8/2003 | Gandy | |
| 6,675,521 | B1 | 1/2004 | Kim | |
| 6,742,299 | B2 | 6/2004 | Strand | |
| 7,140,118 | B2 | 11/2006 | Adrian | |
| 7,234,263 | B2 | 6/2007 | Thiakos | |
| 7,243,434 | B1 | 7/2007 | Zucker | |
| 7,331,137 | B2 | 2/2008 | Hsu | |
| RE40,429 | E | 7/2008 | Oliver et al. | |
| 7,753,549 | B2 | 7/2010 | Solinsky et al. | |
| 2007/0147042 | A1 * | 6/2007 | Sharrah et al. | 362/276 |
| 2008/0000133 | A1 | 1/2008 | Solinsky et al. | |
| 2008/0066363 | A1 | 3/2008 | Grauslys et al. | |

FOREIGN PATENT DOCUMENTS

| | | |
|---|---|---|
| CN | 11275818 | 10/2008 |
| RU | 2212617 C2 | 9/2003 |

* cited by examiner

*Primary Examiner* — Jason Moon Han
(74) *Attorney, Agent, or Firm* — Gifford, Krass, Sprinkle, Anderson & Citkowski, P.C.

(57) ABSTRACT

A laser aiming device incorporated into a battery cap housing, which is in turn secured to such as an existing gun sight and which is in communication with the sights primary power source, such as a battery. The laser aiming device constitutes such as a diode and adjustment mechanism attached to a weapon sight battery source and, by virtue of a circuit closing cap insert, powering itself off the same. As such, the device is capable of being attached to the other side of the battery cap, while running off the single (primary) battery source associated with the cap.

11 Claims, 4 Drawing Sheets

LASER AIMING DEVICE INTEGRATED INTO AN ELECTRO-OPTIC BATTERY SOURCE SUCH AS ASSOCIATED WITH A HOLOGRAPHIC SIGHT

FIELD OF THE INVENTION

The present invention discloses a laser aiming device incorporated into a battery cap housing, which is in turn secured to such as an existing gun sight and which is in communication with the sights primary power source, such as a battery. The laser aiming device constitutes such as a diode and adjustment mechanism attached to a weapon sight battery source and, by virtue of a circuit closing cap insert, powering itself off the same. As such, the device is capable of being attached to the other side of the battery cap, while running off the single (primary) battery source associated with the cap.

BACKGROUND OF THE INVENTION

The prior art is well documented with various types of laser sighting devices. Such laser sighting devices typically require a dedicated or secondary battery or other power source for assisting in the operation of a secondary weapon accessory such as a laser aiming device. Examples of known holographic sights include the L-3 EOTech Holographic Weapon Systems, such as the 552.A65. Other known module laser aiming devices capable of attaching to a side of the holographic weapon sight housing include the EOLAD Laser with Tactical Light Mount, produced by Laser Devices, Inc.

SUMMARY OF THE INVENTION

The present invention discloses a laser aiming device incorporated into a battery cap housing, which incorporates a separate laser housing secured to the battery cap, and which is in turn secured to an existing gun sight and in communication with the sights primary power source, such as a built in battery. The laser aiming device constitutes such as a diode and adjustment mechanism, these incorporated into a separate secondary housing and communicated to the weapon sight battery source and, by virtue of a circuit closing cap insert, powering itself off the same. As such, the device is capable of being attached to the other side of the battery cap, while running off the single (primary) battery source associated with the cap, thus removing the need for a second weapon accessory for functioning as the weapons laser aiming device with a net savings in weight and cost.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
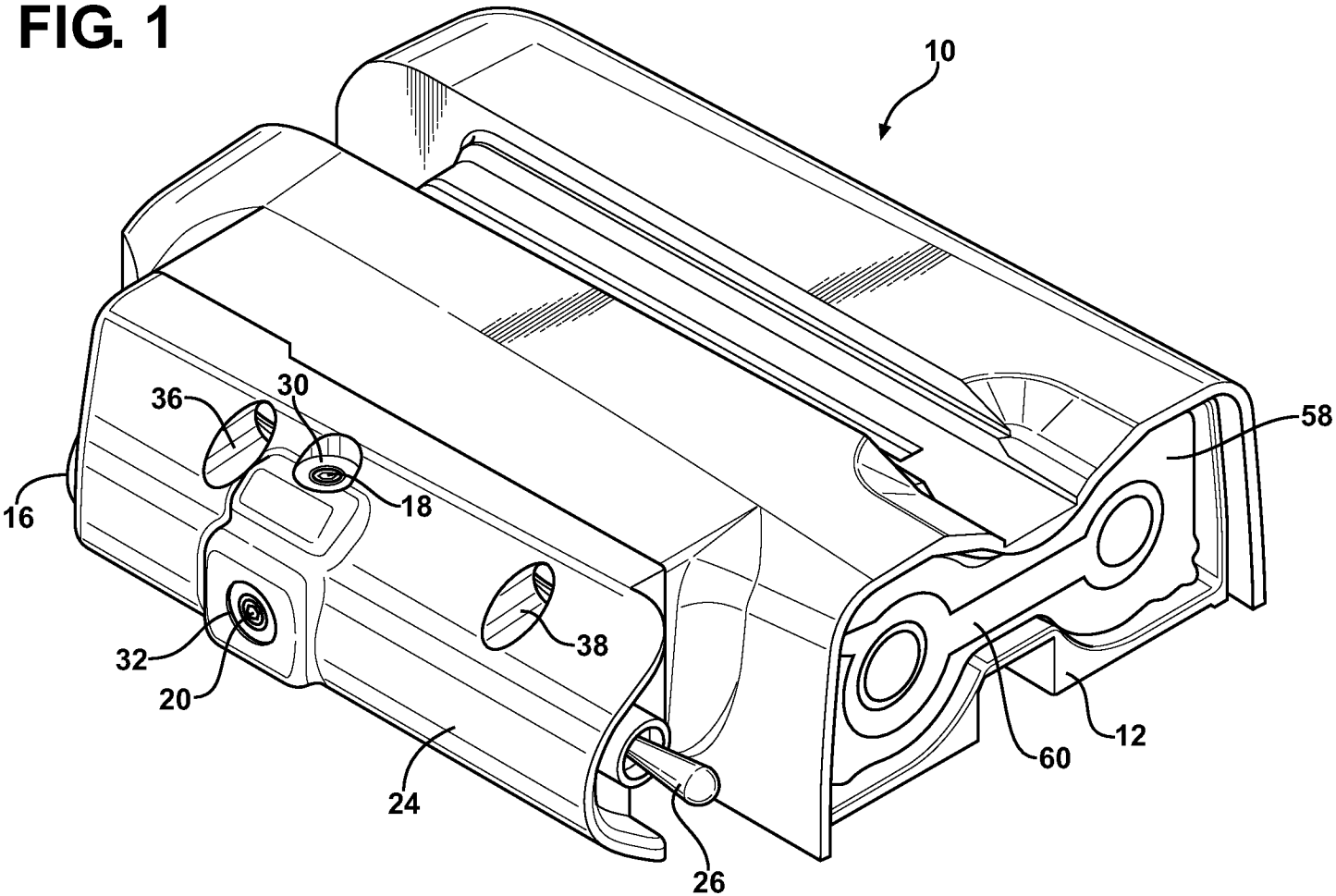
FIG. 1 is an assembled perspective view of the laser aiming device integrated into an electro-optic battery source according to an embodiment of the present invention.

Referring now to the several illustrations, and in particular to FIG. 1, the present invention discloses a laser aiming device 10 incorporated into a main battery housing 12, which is in turn secured to an existing gun sight and which is in communication with the sights primary power source, such as a battery (see for example of pair of AA size batteries 14). The laser aiming device constitutes such as a diode 16 and adjustment mechanism (see horizontal and vertical adjustment knobs 18 and 20 in the exploded view of FIG. 2) attached to an electrically conducting (or bus) support surface 22 associated with the weapon sight battery source. The diode 16 is communicated with the conducting support surface 22 via a communicating spring 17.

An auxiliary (side mounted) laser housing 24 is provided and secures over an exposed side of the main housing in order to cover the diode 16 and a rear situated on/off toggle switch 26, the switch 26 further including a platform contact surface 27 likewise in communication with the bus surface 22. The laser housing 24 as shown is configured to include a forward aperture 28 to seat the lens of the diode 16, additional intermediate access holes 30 and 32 to access the adjustment knobs 18 and 20, and a rear access hole 34 through which extends the on/off toggle switch 26. Additional side holes 36 and 38 are configured for receiving therethrough mounting screws 40 and 42 for securing the side cover 24.

Figure 3:
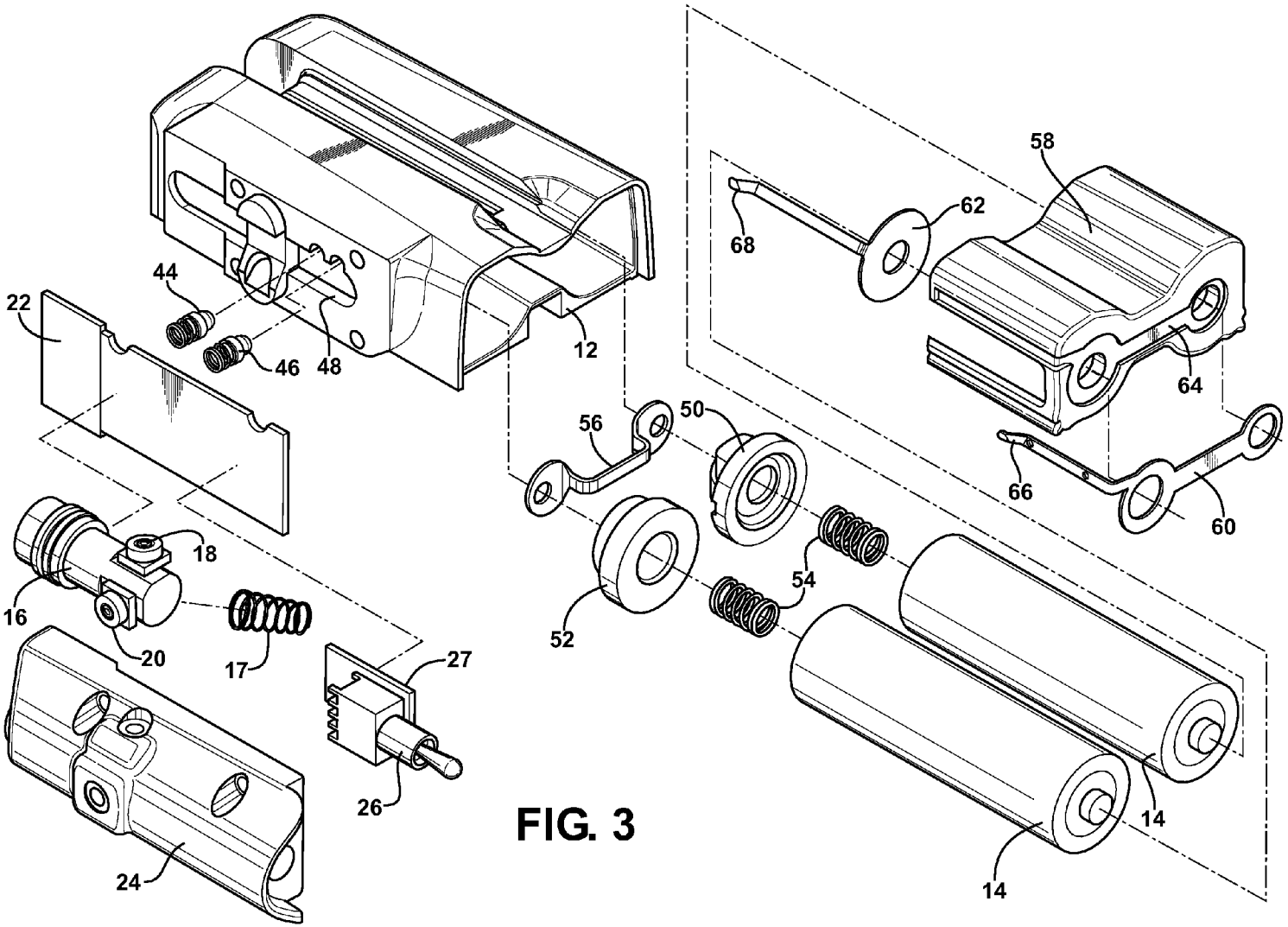
FIG. 3 is a fully exploded view of the laser aiming device and illustrating the various components.

As additionally shown in FIG. 3, additional features include side accessible battery contacts 44 and 46 accessible through an aperture 48 defined in a configured side surface of the main housing 12 and in order to communicate power to the diode 16 and toggle switch 26. Additional features include a battery bumper contact 50 and secondary contact 52 aligning with the batteries 14 and respectively electrically conducting via interposed springs 54. A battery connector 56 is located within an inside forward end of the battery cap housing 12 and, upon insertion of the batteries 14, is electrically contacted by the forward facing battery bumper 50 and secondary 52 contacts.

Figure 4:
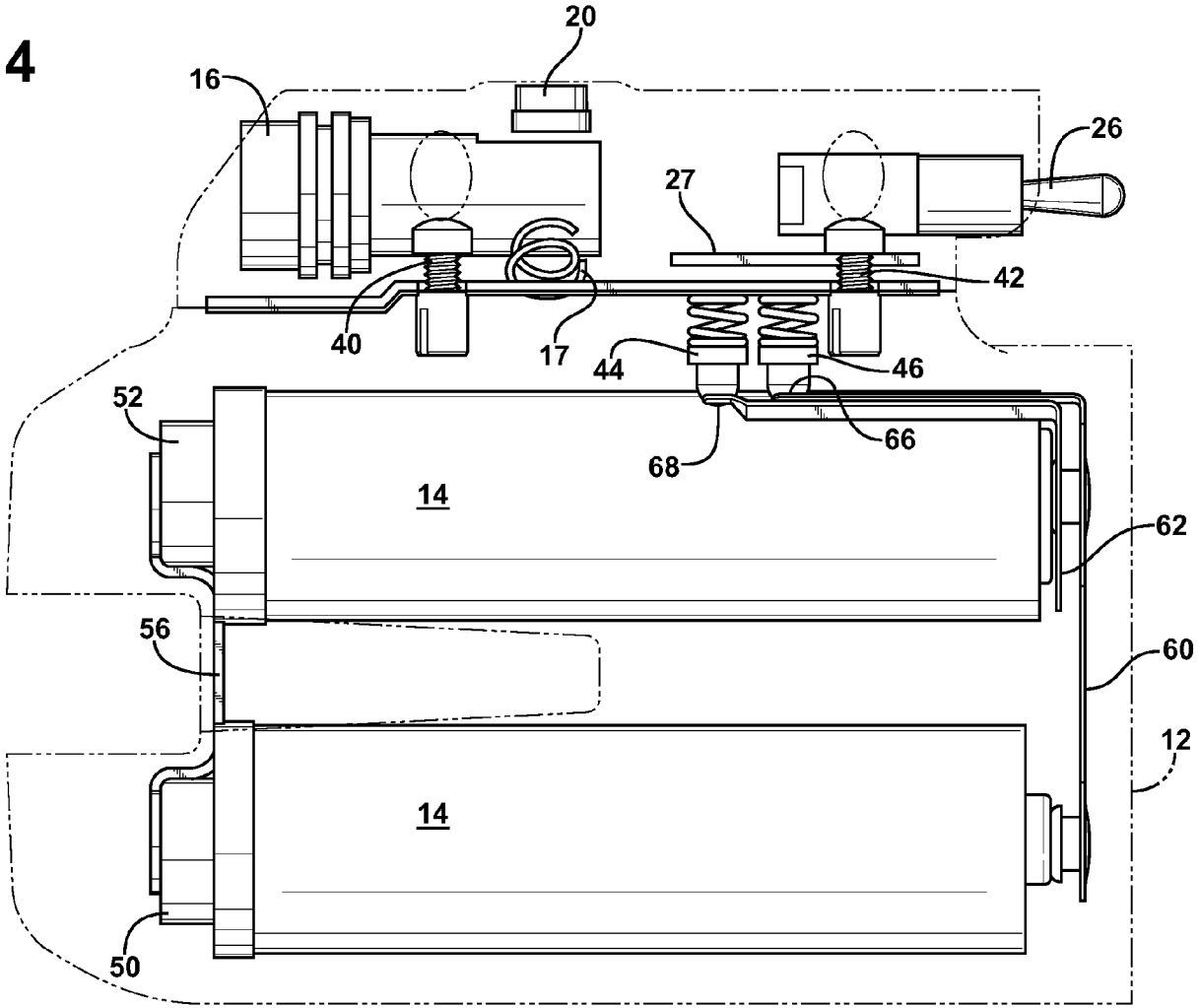
FIG. 4 is a top view of the laser aiming device and illustrating the outer housing in phantom.

Other features include a battery insert housing 58 mounted over an exposed rear of the battery (cap) housing 12, in communication with the positive terminals of the batteries 14. A positive contact 60 and negative contact 62 are further provided in configured fashion, with the positive contact 60 including a base contact portion seating within a recess template 64 defined in a rear exposed surface of the battery insert housing 58, a corresponding base contact portion of the negative contact 62 seating inside the housing 58 in contact with an inside end face of the housing 58 and through which a positive contact post of a selected battery 14 extends. Extending ends of the positive contact 60 (at 66) and the negative contact 62 (at 68) contact the accessible battery contacts 44 and 46 in the manner illustrated in FIG. 4 such that, upon toggling the switch 26, for powering the diode 16. As such, the device is capable of being attached to the other side of the battery cap, while running off the single (primary) battery source associated with the cap (e.g. again the batteries shown at 14).

The diode 16 functions as the aiming device for the weapon and, as again shown in the illustrations, projects from the left side of the battery cap housing 12 along with the adjustment mechanism knobs 18 and 20 which can further include the features of hex head adjustment. The laser diode 26 is not envisioned to operate continuously, rather it is activated by the small toggle switch 16 located at the back of the diode housing 24 as shown. It is also envisioned that the toggle switch can be substituted by a pressure pad switch which can be attached to another area of the weapon (not shown) and engaged by the user in order to activate the diode.

In this fashion, the user has the ability to zero the laser to the impact point of a projectile (e.g. bullet) fired by the associated weapon. Upon activating the diode 16, the shooter has the ability to place the laser aiming point (see again laser housing 24) on the target and, upon depressing/squeezing the trigger, ensures that the round discharged will impact at the laser aiming point.

As disclosed, the battery cap housing 58 fits upon a holographic weapon sight and such as which is powered by an alkaline or lithium ion type battery. The battery cap housing 58 constitutes a housing having a generally three dimensional shape including a bottom configured surface suitable for mounting to such as a weapon or other location (not shown).

Figure 2:
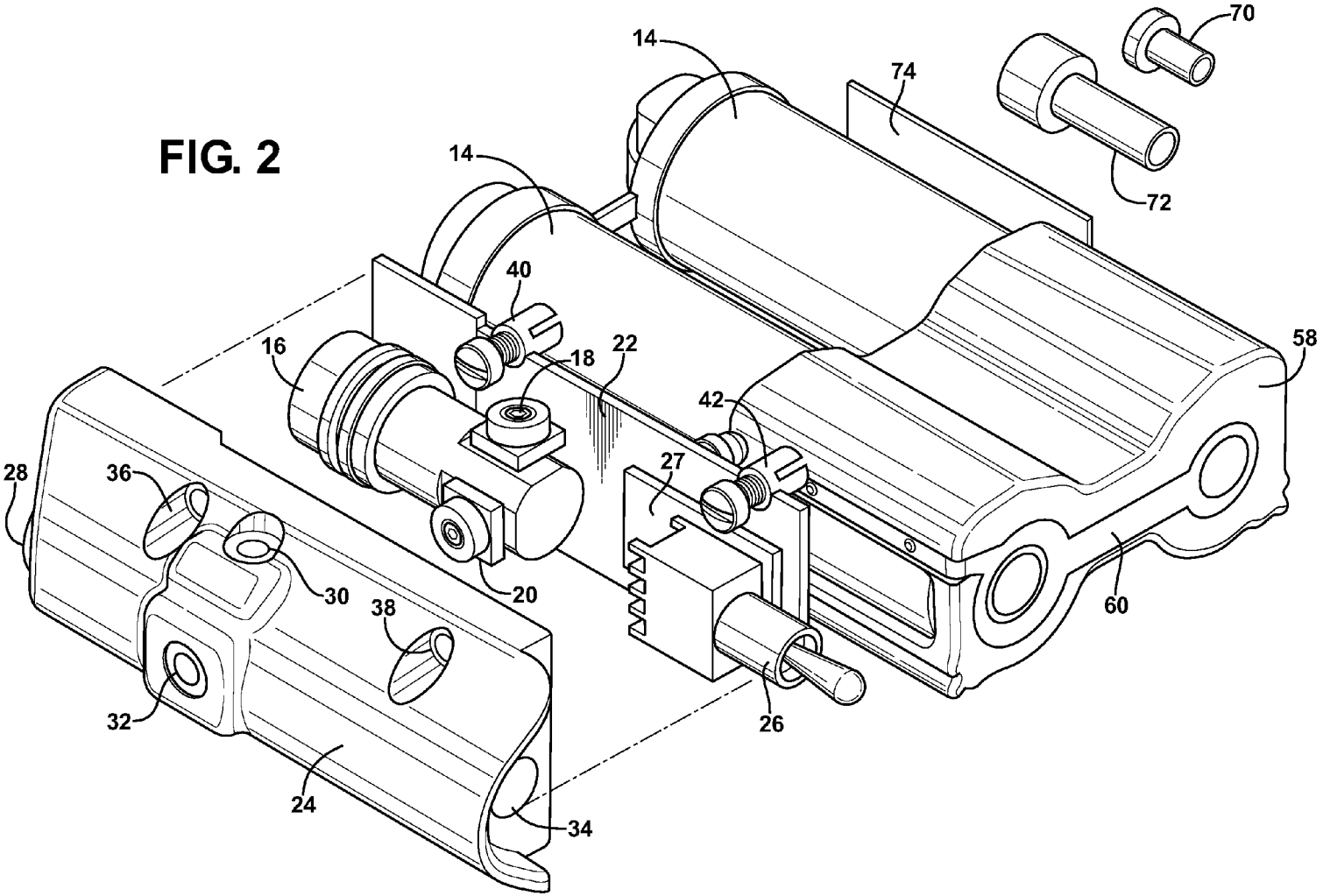
FIG. 2 is an illustration of the device shown in FIG. 1 and showing in partially exploded fashion the laser aiming diode and adjustment mechanism secured to a side of a central battery cap and support housing and powered off a common battery source which operates the separate laser housing.

Additional envisioned embodiments contemplate the laser diode 16 being provided as a visible aiming laser, an infrared aiming laser, infrared illuminator or other LED generating light source. It is also contemplated that the other side of the battery cap housing 12 (see as shown in FIG. 2) can incorporate an additional diode or flashlight molded (see as shown by LED light 70 and infrared illumination element 72) which likewise operates using the same battery/power source such as via a further communicating surface 74 which can be powered by additional or further reconfigured positive and negative contacts (not shown) for providing necessary power from the batteries 14.

The present construction of the single battery cap housing 12 with laser diode 16 (via housing 24) again removes the need for a secondary battery source for powering the laser aiming device as well as any other ancillary device attached to the battery source. This results in less weight and bulk attached to the weapon as well as providing more equal balancing/centering of the battery cap housing which provides the additional benefit of improving the accuracy and endurance of the shooter by removing the need for additional aiming devices. It is also envisioned that the present device can be retrofit applied to existing laser sights as well as forming an integral component in a dedicated sight assembly manufactured according to the specifications of the present invention.

Having described my invention, other and additional preferred embodiments will become apparent to those skilled in the art to which it pertains, and without deviating from the scope of the appended claims.

We claim:

1. An aiming device incorporated into an electro-optic power source which is in turn mounted atop a weapon sight assembly, said aiming device comprising:

an enclosed battery compartment defined by a main housing and a rear attachable cover collectively defining a three dimensional interior incorporating at least one battery;

an aperture defined in a side of said main housing and from which project contacts extending from said batteries;

a planar shaped bus component exhibiting an inner conducting surface, said planar bus component extending along an exterior of said main housing and covering said side defined aperture with said inner conducting surface in communication with said battery contacts;

a laser aiming diode and adjustment mechanism built into a first sub-housing securing against an outer conducting surface of said planar shaped bus component;

an on/off switch in further communication with said outer conducting surface of said bus component for selectively powering said laser aiming diode from said batteries separate from powering of the weapon sight assembly; and said planar bus component providing electrical communication at any location along each of said inner and outer surfaces while also environmentally sealing both said main housing and sub-housing.

2. The invention as described in claim 1, further comprising a second illuminating light source secured to a further location of said main housing and also operating off said batteries.

3. The device as described in claim 1, said main housing further comprising a battery cap housing and said rear attachable cover further comprising a battery insert housing incorporated into said battery cap housing.

4. The device as described in claim 3, said contacts further comprising a positive contact including a base contact portion seating within a recess template defined in a rear exposed surface of said battery insert housing, a corresponding base contact portion of a negative contact seating inside said housing in contact with an inside end face and through which a positive contact post of a selected battery extends.

5. The device as described in claim 4, further comprising extending ends of said positive contact and negative contact communicating with battery contacts in contact with said conducting surface.

6. The device as described in claim 3, further comprising a battery connector mounted within an inside forward of said battery cap housing.

7. The device as described in claim 6, further comprising a battery bumper seating in engaging contact with said battery insert housing and having positive and negative contact portions.

8. The device as described in claim 1, further comprising a second light source incorporated into a second sub-housing secured to a side of said main housing opposite said first sub-housing.

9. The device as described in claim 8, said second light source further comprising at least one of an LED light and an infrared illumination element likewise operating from said battery via a further communicating surface.

10. The device as described in claim 1, said first sub-housing further comprising a forward aperture for seating said laser aiming diode, additional intermediate access holes in said first sub-housing providing access to adjustment knobs associated with said diode, said first sub-housing further comprising a rear access hole through which extends said on/off switch.

11. The device as described in claim 10, said first sub-housing further comprising additional side holes configured for receiving therethrough mounting screws for securing to said body.

* * * * *